US007686011B1

(12) United States Patent
Williams

(10) Patent No.: US 7,686,011 B1
(45) Date of Patent: Mar. 30, 2010

(54) COMPACT WINDOW HEATING UNIT UTILIZING PELLETIZED FUEL

(75) Inventor: Paul Williams, Bridgeport, AL (US)

(73) Assignee: United States Stove Company, South Pittsburgh, TN (US)

( * ) Notice: Subject to any disclaimer, the term of this patent is extended or adjusted under 35 U.S.C. 154(b) by 626 days.

(21) Appl. No.: 11/522,123

(22) Filed: Sep. 15, 2006

(51) Int. Cl.

| | |
|---|---|
| ***F24B 1/18*** | (2006.01) |
| ***F24B 1/187*** | (2006.01) |
| ***F24H 3/02*** | (2006.01) |
| ***F23K 3/10*** | (2006.01) |
| ***F23K 3/14*** | (2006.01) |
| ***F23N 5/00*** | (2006.01) |

(52) U.S. Cl. ..... 126/520; 110/185; 110/110; 110/108; 126/110 B; 126/502

(58) Field of Classification Search ..... 126/110 B, 126/116 B, 520, 190, 173 C, 173 R, 502; 62/262; 110/175 A, 173 R, 185
See application file for complete search history.

(56) References Cited

U.S. PATENT DOCUMENTS

| | | | | |
|---|---|---|---|---|
| 633,712 | A | 9/1899 | Badger | |
| 1,652,268 | A | 12/1927 | Benjamin | |
| 2,582,066 | A * | 1/1952 | Resek | 126/110 B |
| 2,632,435 | A | 3/1953 | Lundstrum | 126/90 |
| 2,673,558 | A | 3/1954 | Budlane | 126/116 |
| 2,728,311 | A * | 12/1955 | Campbell | 110/190 |
| 3,680,541 | A * | 8/1972 | Honaker, Jr. | 126/85 B |
| 3,970,067 | A * | 7/1976 | Vaughn | 126/518 |
| RE29,443 | E * | 10/1977 | Vaughn | 126/518 |
| 4,132,353 | A * | 1/1979 | Briggs et al. | 236/10 |
| 4,259,941 | A * | 4/1981 | Gerdes | 126/515 |
| 4,432,335 | A * | 2/1984 | Kilham | 126/60 |
| 4,630,553 | A * | 12/1986 | Goetzman | 110/214 |
| 4,848,310 | A * | 7/1989 | Millington | 126/4 |
| 4,881,472 | A | 11/1989 | Stromberger | 110/186 |
| 4,922,889 | A | 5/1990 | Nuesmeyer | 126/73 |
| 5,027,614 | A * | 7/1991 | Mori et al. | 62/262 |
| 5,123,360 | A | 6/1992 | Burke | 110/233 |
| 5,165,883 | A * | 11/1992 | Van Bemmel | 431/6 |
| 5,243,963 | A | 9/1993 | Riener | 126/107 |
| 5,331,943 | A | 7/1994 | Ko | 126/73 |
| 5,477,913 | A * | 12/1995 | Polk et al. | 165/11.1 |
| 5,718,217 | A * | 2/1998 | Aleman et al. | 126/500 |
| 5,873,356 | A * | 2/1999 | Vossler et al. | 126/110 E |
| D431,289 | S | 9/2000 | Paquette | 23/350 |
| 6,336,449 | B1 | 1/2002 | Drisdelle | 126/73 |
| 7,318,431 | B1 * | 1/2008 | Holtan et al. | 126/7 |
| 2004/0045543 | A1 * | 3/2004 | Perryman | 126/95 |

* cited by examiner

*Primary Examiner*—Kenneth B Rinehart
*Assistant Examiner*—David J Laux
(74) *Attorney, Agent, or Firm*—Waddey & Patterson PC; I. C. Waddey, Jr.

(57) ABSTRACT

The invention relates to heating units mounted on a window of an existing building. Flue gases are expelled outside of the building without the need for wall modifications or an extra chimney. The actual burn chamber is mounted on a window mounting unit with an interior support which extends into the building thereby heating the air inside the building.

27 Claims, 7 Drawing Sheets

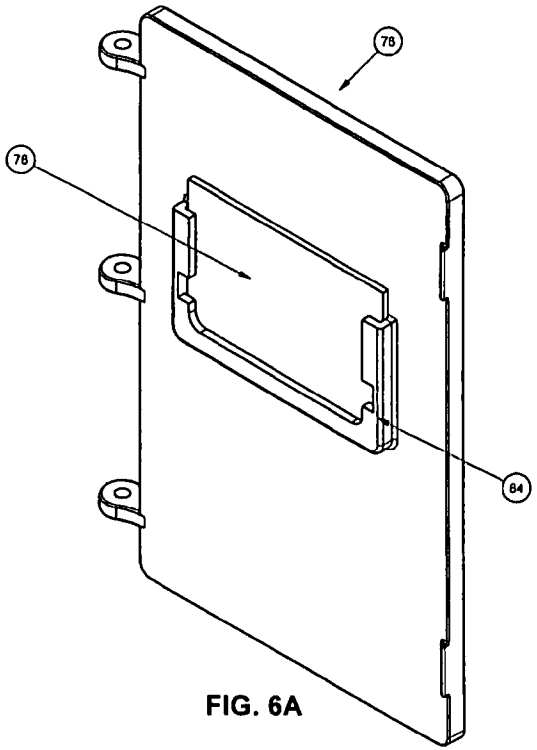
FIG. 6A
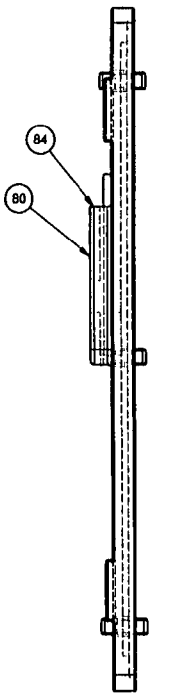
FIG. 6C
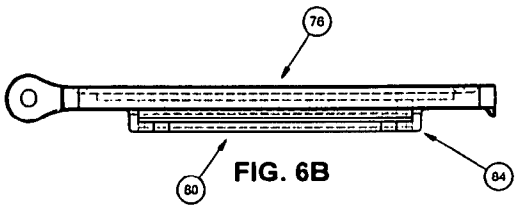
FIG. 6B
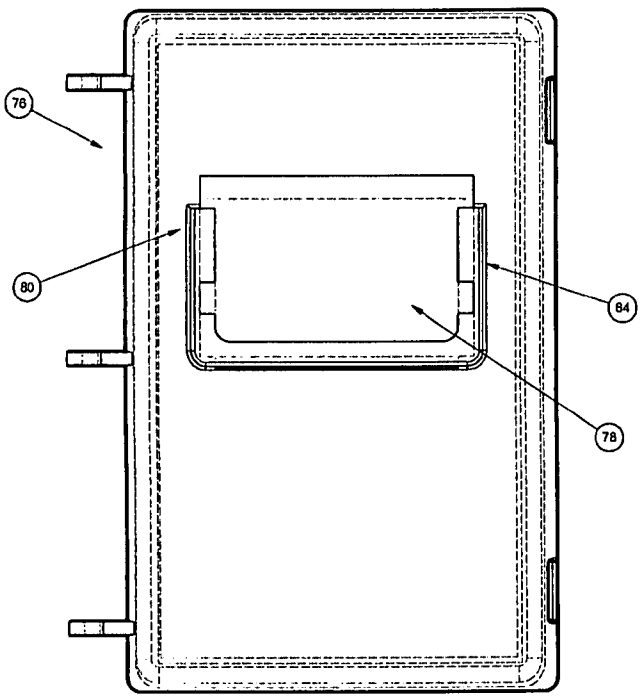
FIG. 6D
FIG. 6

COMPACT WINDOW HEATING UNIT UTILIZING PELLETIZED FUEL

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to heating units.

More particularly, this invention relates to heating units mounted on a window of an existing building. Often owners of buildings such as homes and small businesses desire a method of heating a limited area within the structure. This may permit a building owner to heat only certain areas in the building thereby providing significant cost savings. In addition, the building owner may simply want to provide extra heating to a particular location in the building without having to heat the remainder of the building to the desired temperature.

Heating units burning pelletized fuel provide an efficient and cheap method of heating certain locations of the home or building. A heating unit with the ability to mount on the window, while safely expelling the resulting flue gas outside the building, provides the owner with the ability to heat any location with window access.

Prior art window heating units have several disadvantages. A first prior art heating unit requires a specialized chimney in order to expel flue gases. The device has back walls which extend into a mobile home. Upon mounting on the window, doors for entering fuel into the firebox are located outside the mobile home. Furthermore, a passage in communication with the outside of the mobile home provides access to outside air for combustion. This outside air enters through the bottom of the firebox, burns the pelletized fuel and is elevated through a chimney inside the mobile home. This device clearly has several limitations. First, the location of the device is limited by the location of the chimney in the mobile home. Second, the doors for inserting the fuel are located outside the mobile home, requiring an owner to go outside in order to provide additional fuel for the heating unit. Finally, the device only heats the back walls of the firebox. The device thus does not provide a method of blowing warm air into the building.

In a second prior art embodiment, the heating unit is mounted on a window with a pair of rail members, one on the top and one on the bottom of the window. The rail members embodying the guide tracks are respectively adapted to seat the lower edge of the window and the upper edge of the window sill upon which the heating unit is mounted. Surrounding the heating unit is a generally rectangular U-shaped frame. This U-shaped frame inserts into the guide tracks thereby mounting the heating unit within the building. However, such a configuration is prone to damage the window. The entire weight of the heating unit is supported in the window sill through a thin rail. Consequently, a tremendous amount of pressure is placed on the window sill.

BRIEF SUMMARY OF THE INVENTION

What is needed is a heating unit which can be easily supported on a window sill and which does not require the use of a specialized chimney to expel the resultant flue gas. The invention is a heating unit for burning a pelletized fuel which is adapted to be mounted in the window of an existing building. The heating unit has a burn chamber housing with an interior and an exterior. Within the interior of the housing is a burn chamber for burning the pelletized fuel. The burn chamber has a burn pot mounting within the burn chamber and receiving the pelletized fuel. On the exterior of the burn chamber are heat radiating fins for facilitating the heating of the air surrounding the housing. A first blower creates an air flow between a combustion air inlet in the burn chamber housing and a flue gas outlet in the burn chamber housing. In this manner, the heating unit provides combustion air for the burn chamber and expels the resultant flue gas. Finally, the burn chamber is mounted within the building. This is achieved with a window mounting apparatus for mounting the heating unit on the window with an interior support portion. Thus, when the burn chamber housing is mounted on the interior support portion, the housing is within the building. Furthermore, the device may contain a hopper for storing the pelletized fuel and an auger connected to the hopper delivering the pelletized fuel into the burn chamber. The window mounting apparatus may further comprise an exterior support portion which extends outside the building and mounts the hopper to the window.

Accordingly, one object of the present invention is to mount a heating unit on a window.

Another object of the present invention is to mount a burn chamber housing within the interior of a building.

Yet another object of the present invention is to mount a hopper on a window in the exterior of a building.

Still another object of the present invention is to deliver air from outside the building into the combustion chamber.

Still yet another object of the present invention is to provide a controller which can monitor and control the heating unit.

BRIEF DESCRIPTION OF THE SEVERAL VIEWS OF THE DRAWINGS

FIG. 6A is a perspective view of the removable door.

FIG. 6B is a top view of the removable door with the cover plate inserted.

FIG. 6C is a side view of the removable door with the cover plate inserted.

FIG. 6D is a front view of the removable door with the cover plate inserted.

DETAILED DESCRIPTION OF THE INVENTION

Figure 1:
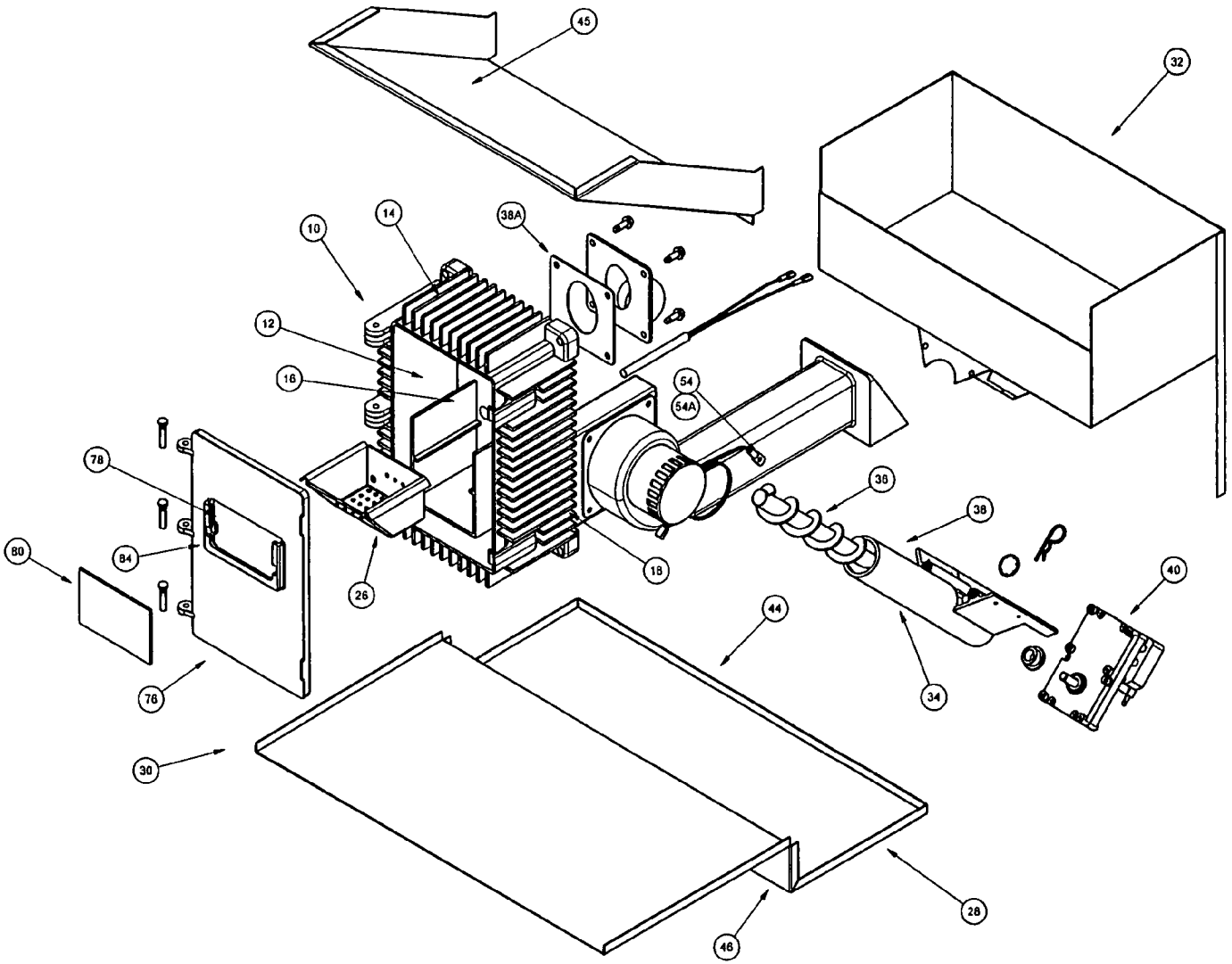
FIG. 1 is an exploded perspective view of the heating unit.
Figure 2:
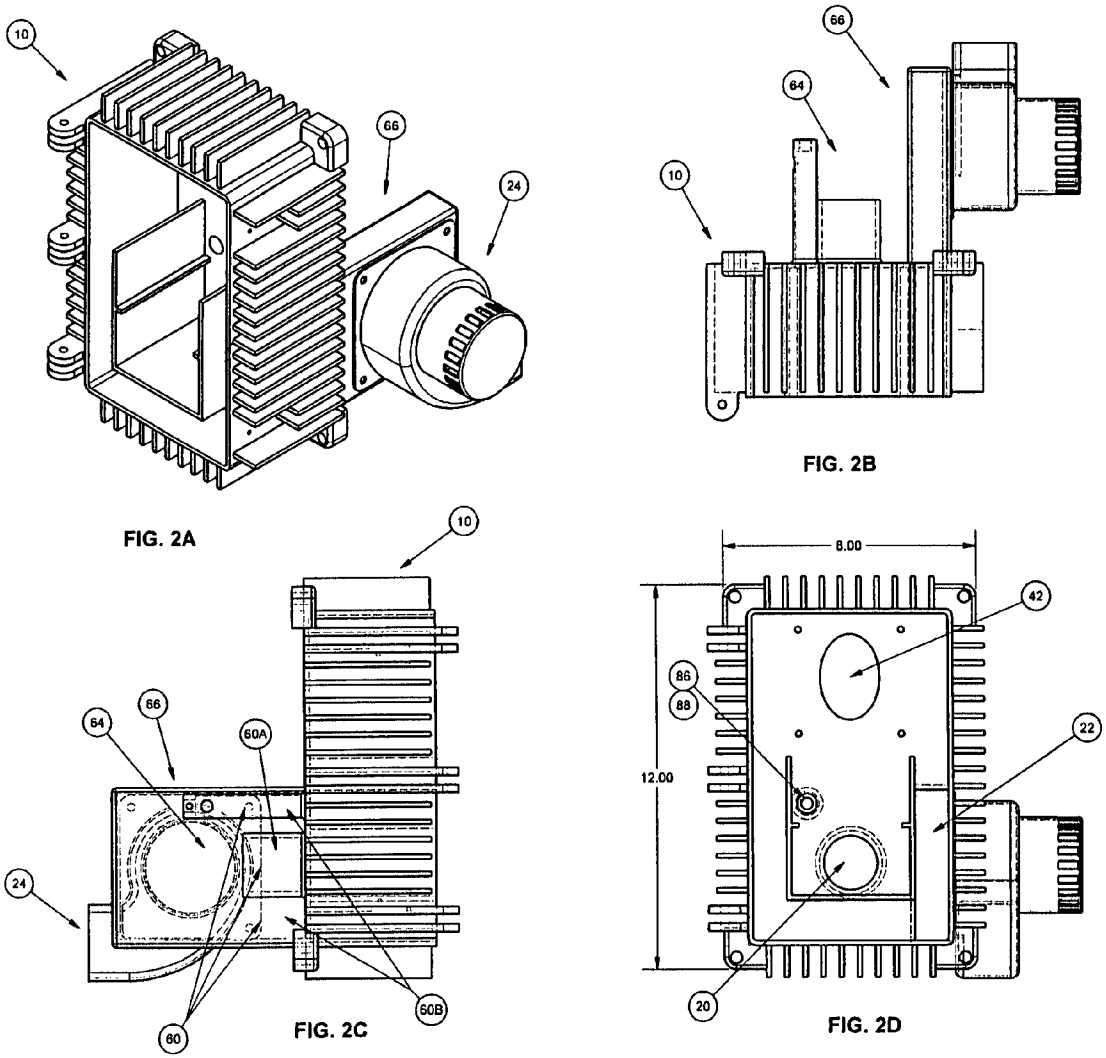
FIG. 2A is a perspective view of the burn chamber housing without the removable door.
FIG. 2B is a top view of the burn chamber housing.
FIG. 2C is a side view of the burn chamber housing.
FIG. 2D is a front view of the burn chamber housing without the removable door, thereby exposing the interior of the burn chamber housing.
Figure 3:
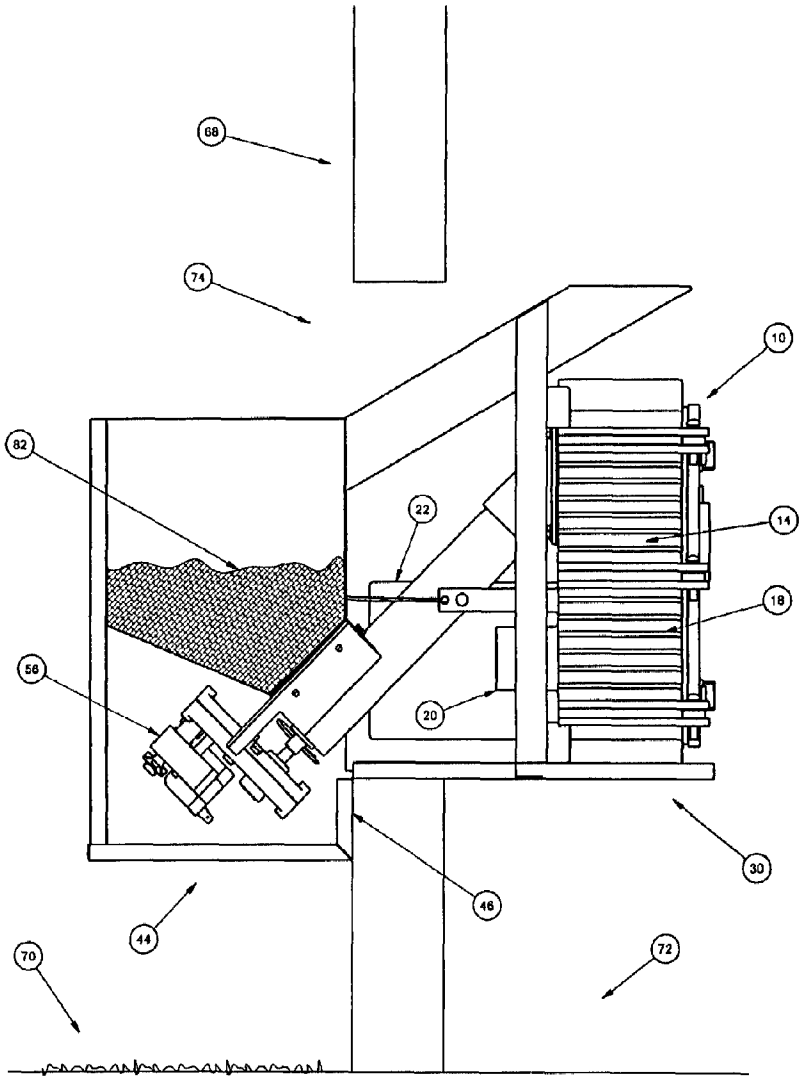
FIG. 3 is a side view of the heating unit wall mounted on a window of an existing building.

Referring now to FIGS. 1, 2 and 3, a heating unit has a burn chamber housing 10 with an interior 12 and an exterior 14. In the interior 12 of the housing 10, the housing 10 has a burn chamber 16. Along the exterior 14 of the housing 10, heat radiating fins 18 facilitate the heating of the air surrounding the housing by increasing the surface area heated by the housing.

The housing 10 combines a combustion air inlet 20 for receiving combustion air into the burn chamber 16 and a flue gas outlet 22 for expelling a flue gas 60B from the burn chamber 16. A first blower 24 creates an air flow 60 between the combustion air inlet 20 and the flue gas outlet 22 such that a combustion air path is created for the heating unit. In the preferred embodiment, the first blower 24 creates a vacuum induced air flow to ensure that flue gases 60B are exhausted from the burn chamber 16.

Within the burn chamber 16, a burn pot 26 receives the pelletized fuel 82. A burn pot 26 mounts within the burn chamber 16. The burn pot 26 may have a permanent mount or a removable mount within the burn chamber 16. For example, the burn pot may be welded inside the burn chamber 16. In the alternative, the burn pot 26 may come equipped with a series of channels which fit over rails within the burn chamber 16. In addition, the burn pot may be screwed, clamped, or hung on the burn chamber 16. In fact, any method for mounting the burn pot 26 is acceptable so long as it can withstand the heat within the burn chamber 16 during operation of the heating unit.

Next, the heating unit has a window mounting apparatus 28 for mounting the heating unit on the window 74. The window mounting apparatus 28 is mounted to the window 74 by any acceptable method. Thus, the mounting apparatus 28 may be screwed, clamped, or inserted in window 74. The user of the heating unit may use any acceptable method of mounting the heating unit on the window sill so long as the mounting method can support the weight of the heating unit to be mounted. Furthermore, the window mounting apparatus 28 has an interior support portion 30 which extends into the building 68 when the heating unit is mounted on the window 74. The housing 10 is mounted on the interior support portion 30 whereby the interior support portion 30 supports the housing 10 inside the building 68. In this manner, the housing 10 may heat the inside of the building 68 and remain inside the building 68.

Next, the heating unit may come equipped with a device for storing and delivering the pelletized fuel into the burn chamber 16. In one embodiment, the heating unit has a hopper 32 for storing the pelletized fuel 82. Pelletized fuel 82 may be wood pellets, soybeans, cherry pits, wheat or the like. In fact, pelletized fuel 82 may be any acceptable biomass source. An auger 34 is connected to the hopper 32 and delivers the pelletized fuel 82 into the burn chamber 16. Many different configurations for augers exist in the art, and the heating unit is not limited to any particular configuration. However, in the preferred embodiment, the auger has a rotating helical shaft 35. The helical shaft is inserted into a feed tube 38 and connected to a motor connector 40. The feed tube 38 has an opening connecting to the hopper 32 whereby pelletized fuel 82 is delivered to the rotating helical shaft 35. The motor connector 40 connects the rotating helical shaft 35 to a motor 41 for driving the auger 34. Feed tube 38 is connected to burn chamber housing 10 with feed tube casting 38A. Upon rotation of the motor 41 pelletized fuel 82 is delivered up the rotating helical shaft 35 and into the burn chamber 16 through auger aperture 42 in the housing 10.

Furthermore, the window mounting apparatus 28 may comprise an exterior support portion 44 which extends outside the building 70 when the heating unit is mounted on the window 74. When mounting apparatus 28 includes exterior support portion 44, the hopper 32 may be mounted on the exterior support portion 44 so that the hopper 32 is located outside the building 70 when the heating unit is mounted on the window 74. Auger 34 will thus deliver pelletized fuel 82 through the window 74 and into the burn chamber 16 inside the building 72. An incline plane 45 may be connected to hopper 32 and extend inside the building 72. In this manner, a user may provide additional pelletized fuel 82 to the hopper 32 from inside the building 72.

Augers, hoppers, and other fuel delivery devices may extend a greater vertical distance than the height of the burn chamber 16. In order to provide an operable configuration, the interior support member 30 must be vertically elevated with respect to exterior support member 44 when the heating unit is mounted on the window 74. To provide this vertical elevation, a step portion 46 is connected between the interior support portion 30 and the exterior support portion 44. The step portion 46 extends vertically and engages the outside of the building 68 when the heating unit is mounted on the window 74. As shown specifically in FIG. 3, neither the hopper 32 nor the auger 34 are restricted by the height of the burn chamber housing 10.

Figure 4:
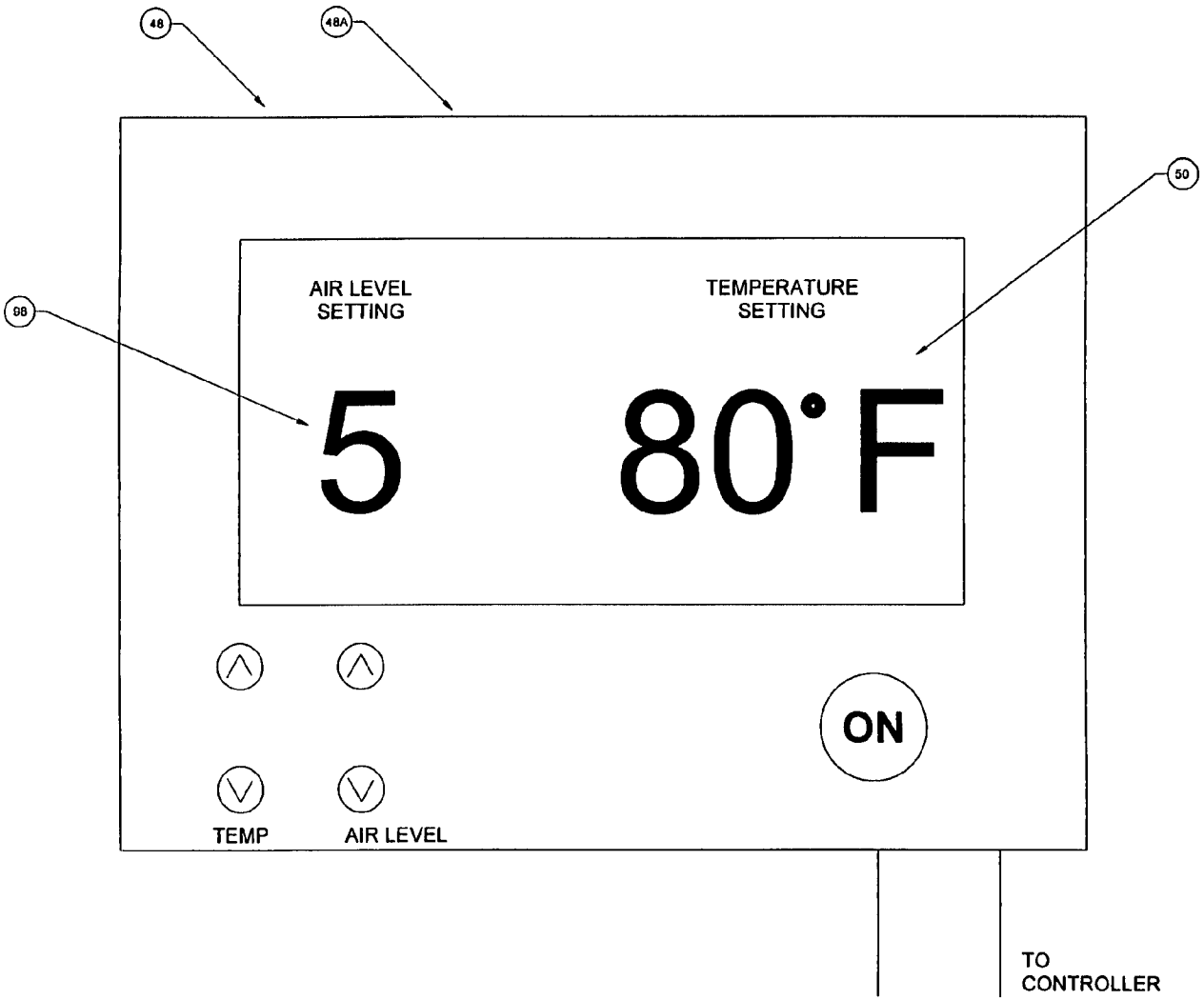
FIG. 4 is a front view of a user interface device.
Figure 5:
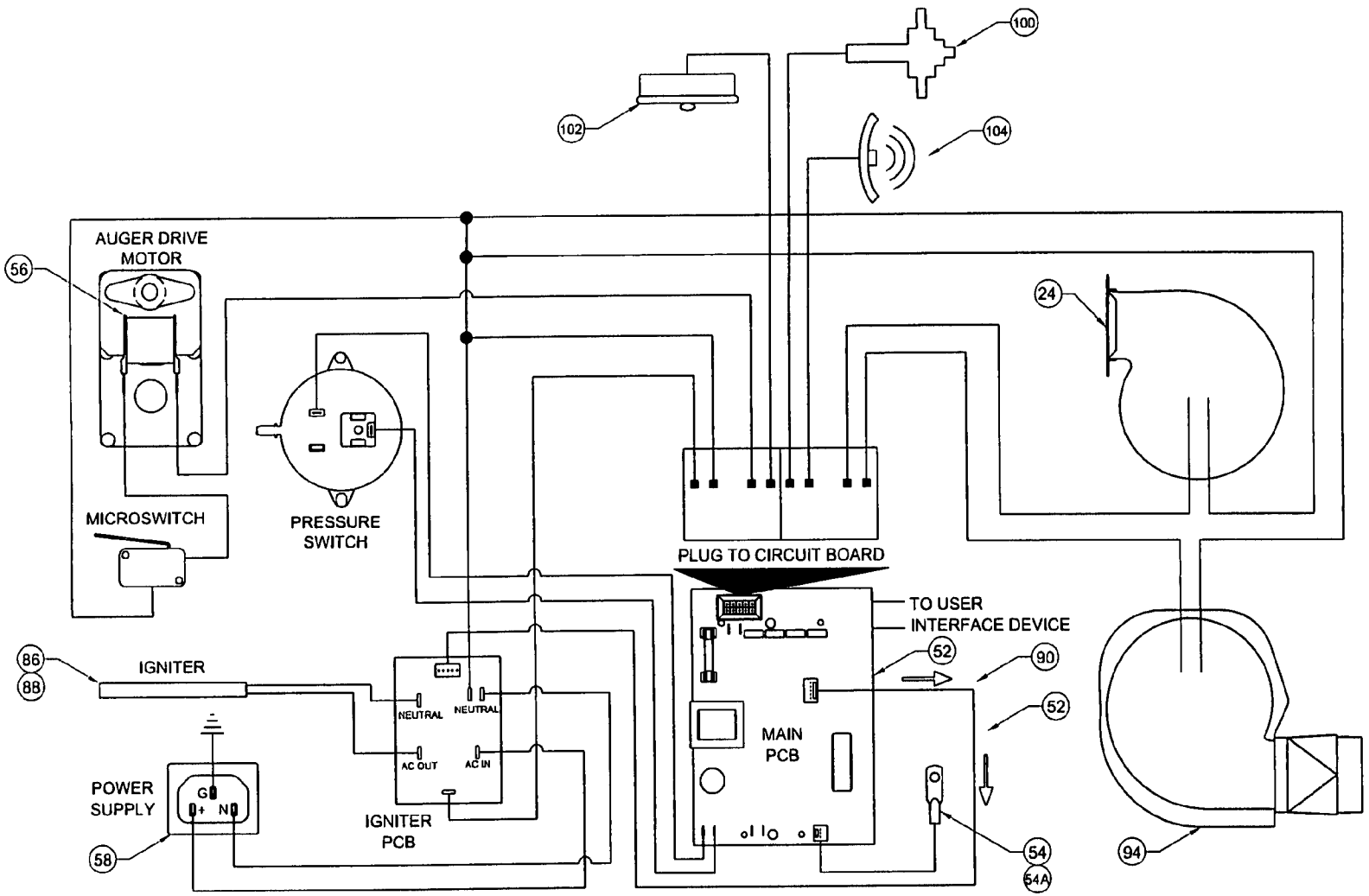
FIG. 5 is a wiring diagram for the heating unit.

Furthermore, the heating unit may perform a variety of controlling and monitoring functions. For example, one of the most important functions is setting an adequate temperature for the housing 10. Referring now to FIGS. 4 and 5, a user interface device 48 inputs a set temperature 50 for the housing 10. In addition, a controller 52 is connected to the user interface device 48 and adjusts the housing 10 to the set temperature 50. A temperature sensing device 54 is connected to the controller 52 for measuring the current temperature on the heating unit. According to the current temperature input from the temperature sensing device 54, the controller 52 adjusts the current temperature so that it is substantially equal to the set temperature 50.

The heating unit may also measure the temperature inside the building 72 directly in order to control the amount of heat output by the housing 10. Referring again to FIGS. 4 and 5, a user interface device 48 inputs a set temperature 50 for inside the building 72. The controller 52 adjusts the inside of the building 72 to the set temperature 50. The temperature sensing device 54 is connected to the controller and measures a current temperature inside the building 72.

In the preferred embodiment the user interface device 48 is a digital display input 48A. Similarly, the controller 52 is a printed circuit board 52A. However, it should be understood that user interface device 48 and controller 52 may be any digital or analog device. Thus for example, the devices may consist of analog thermostats for controlling the temperature of the heating unit. Also, now referring specifically to FIGS. 2D and 5, the temperature sensing device 54 may be a thermistor 54A. The thermistor 54A may sit within the burn chamber 16 and contact the burn pot 26 in order to measure a current temperature on the heating unit.

Referring again to FIG. 5, the controller 52 may be connected to the blower 24 and/or the motor 41. When the controller 52 is connected to the blower 24, the controller 52 adjusts the air flow 60 such that the current temperature is substantially equal to the set temperature 50. In the alternative, when the controller 52 is connected to the motor 41, the controller 52 adjusts the amount of pelletized fuel 82 such that the current temperature is substantially equal to the set temperature 50. As previously elucidated, the controller 52 may be connected to both the motor 41 and the blower 24. Thus, the controller 52 adjusts the air flow 60 and the amount of pelletized fuel 82 such that the current temperature is substantially equal to the set temperature 50.

One of the primary advantages of the current invention is that no wall modifications or chimneys are required. As a result, the heating unit may be placed on any window 74 without the need to consider special modifications to the building 68. In order to facilitate this function, the heating unit may have a combustion air intake passage 64 and a flue gas passage 66. Thus, as shown in FIGS. 2A, 2B, 2C, and 3, the combustion air intake passage 64 extends outside of the building 70 when the heating unit is mounted on the window 74. The combustion air intake passage 64 delivers combustion air 68 from outside the building 70 to the combustion air inlet 20. In this manner, no fresh air kits will be required since the combustion air intake passage 64 is in communication with the outside of the building 70. Similarly, the flue gas passage 66 extends outside of the building 70 when the heating unit is mounted on the window 74. The flue gas passage 66 delivers the flue gas 60B from the flue gas outlet 22 to outside the building 70. With these devices, the intake for the combustion air 60A and the expulsion of the flue gas 60B do not require and are independent to modifications of the building 68.

Also, the temperature of the flue gas 60B may be measured for safety reasons. If the temperature of the flue gas 60B is too hot, the housing 10 is probably too hot thereby risking the integrity of the internal components of the heating unit. Thus, a controller 52 can adjust the flue gas 60B below a maximum temperature. The controller 52 is connected to the motor 41 whereby the controller 52 adjusts the amount of pelletized fuel 82 delivered by the auger 34 and/or the controller 52 is connected to the blower 24 whereby the air flow is adjusted by the controller. A temperature sensing device 54 is connected to the controller and measures a current temperature of the flue gas 60B whereby the controller 52 adjusts the air flow and the amount of pelletized fuel 82 such that the current temperature of the flue gas 60B is not higher than the maximum temperature. Of course, the maximum temperature will depend on the materials for constructing the housing 10 and the type of pelletized fuel 82 being burned within the housing 10.

Next, as shown in FIGS. 1, 6A, 6B, 6C and 6D, housing 10 may further comprise a removable door 76. In the preferred embodiment, the removal of door 76 is pivotally connected to the housing with a series of removable hinge screws. However, the invention is not limited to this embodiment and the removable door 76 may be attached to the housing 10 by any acceptable method so long as closing of the removable door 76 does not cause substantial air leaks. In addition, the door 76 defines an opening 78 which provides access to the burn chamber 16. A cover plate 80 is removably disposed on the opening 78. Thus, if the plate 80 is removed, the opening 78 allows a user to ignite the pelletized fuel 82 within the burn chamber 16. One means of removably disposing the cover plate 80 on the opening 78, is by providing a guide channel 84 which attaches around the opening 78. The cover plate 80 is removably disposed over the opening 78 by inserting the cover plate 80 into the guide channel 84.

Another method of igniting the pelletized fuel in the burn chamber is by providing an igniter 86 in the interior 12 of the burn chamber housing 10. In one embodiment, the igniter 86 is a calrod 88. Referring now to FIGS. 4 and 5, the user interface device 48 and the controller 52 provide an easy mechanism for lighting the igniter 86. The user interface device 48 inputs an on signal 90 to the controller 52 which is connected to the user interface 48. The controller 52 lights the igniter 86 upon receiving the on signal 90.

Figure 7:
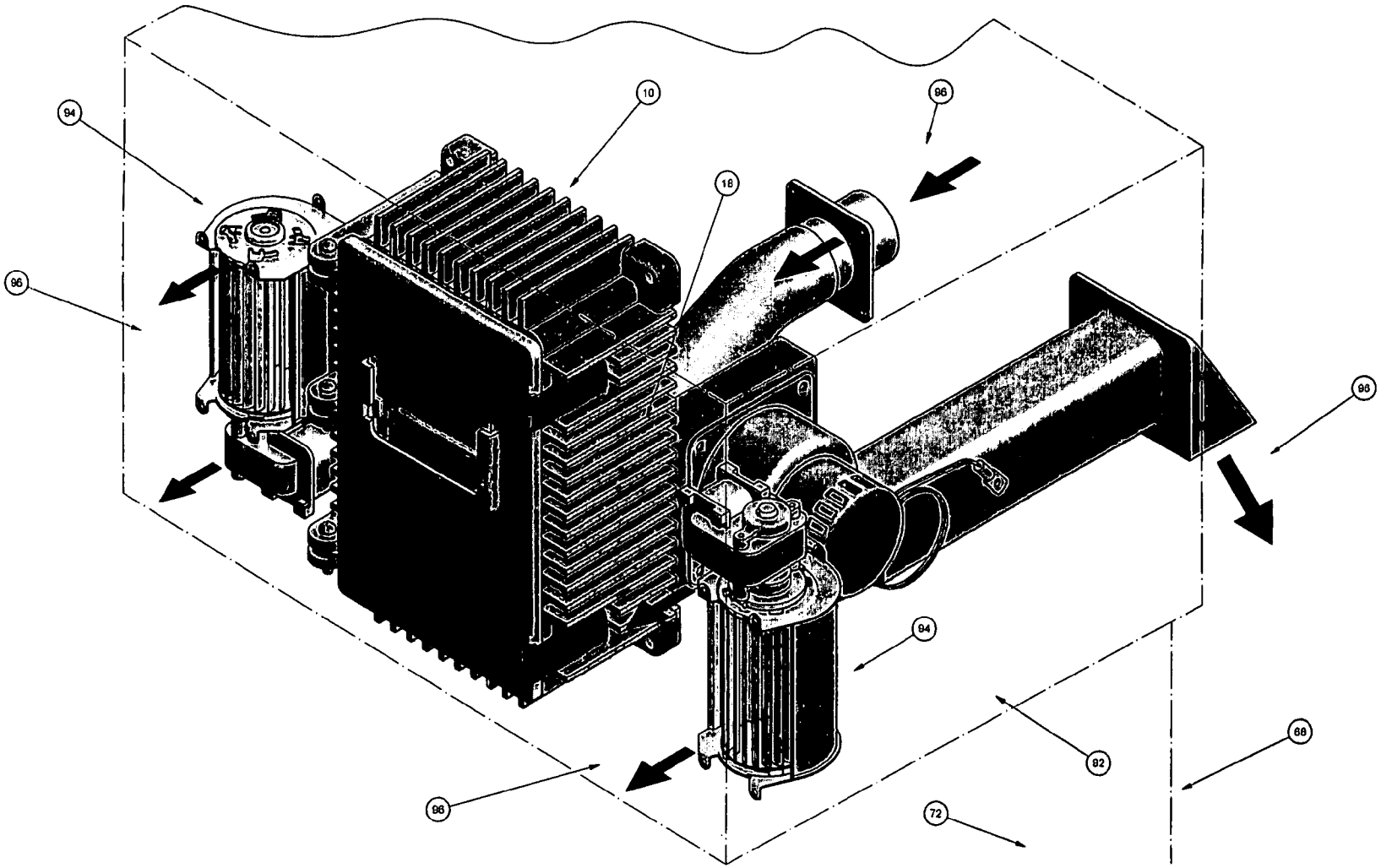
FIG. 7 is a perspective view of the burn chamber housing surrounded by a passage for heating air within the room.

In addition, as shown in FIG. 7, the heating unit may have a room air passage 92 for distributing the air heated by the housing 10 inside the building 72. The room air passage 92 surrounds the exterior 14 of the housing 10. A second blower 94 creates a second air flow 96 through the room air passage 92 whereby air from inside the building 72 is heated by the housing 10 and expelled into the building 68. In one embodiment, the second blower 94 creates a vacuum-induced air flow through the passage 92. Heat radiating fins 18 on the exterior 14 of the housing 10 facilitate heating of the second air flow 96.

Furthermore, the intensity of the second air flow 96 may be regulated with the user interface device 48 and the controller 52. The user interface device 48 inputs an air level setting 98 representing the desired intensity of the second air flow 96. Normally, air level settings 98 are a series of numbers or positions on a dial. The highest air level setting 98 normally represents the highest intensity output of the blower 94, while the lowest air level setting 98 normally represents the least intense output of the blower 94. Numbers or dial positions in between the highest and lowest air level setting represent intermediate outputs of the blower 94. The number of increments is completely arbitrary.

Next, referring to FIG. 2D, in order to provide a preassembled heating unit, the burn chamber housing 10 must fit through the window 74. First, the term window in this application should not be interpreted as requiring a window sill, glass, or a window frame. Instead, window 74 should simply be interpreted as an opening within the building 68 regardless of whether the aforementioned structures exist on the opening. Another common size for a window opening is a width of 22 inches and a height of 15 inches. Thus, in an embodiment, the burn chamber housing 10 is dimensioned with a maximum width of 22 inches and a maximum length of 15 inches.

Referring now to FIG. 5, safety considerations are always prevalent whenever a heating unit is present inside the building 68. Thus, the controller 52 may monitor the heating unit. The controller 52 can monitor for the oxygen level inside the building 68 and/or can detect a smoke level within the building 68. In order to detect the oxygen level, an oxygen sensor 100 is connected to the controller 52. The controller 52 sounds an alarm 104 when the oxygen level is not safe for humans within the building 68. Similarly, in order to detect a smoke level within the building 68, a smoke detector 102 is connected to the controller 52. The controller 52 sounds an alarm 104 when the smoke detector detects unsafe fire conditions within the building 68.

Referring now to FIGS. 5 and 7, another safety hazard is the obstruction of the second air flow 96. A user may place items or furniture or the like in front of room air passage 92 thereby not permitting heat to appropriately leave room air passage 92. As a result, the controller 52 can adjust the second air flow 96 below a maximum temperature. The temperature sensing device 54 is connected to the controller 52 and measures a current temperature of the second air flow 96. In this manner, the controller 52 can assure that the current temperature of the second air flow 96 is not higher than the maximum temperature.

Thus, although there have been described particular embodiments of the present invention of a new and useful compact window heating unit utilizing pelletized fuel, it is not intended that such references be construed as limitations upon the scope of this invention except as set forth in the following claims.

What is claimed is:

1. A modular heating unit for burning a pelletized fuel and adapted to be mounted in a window of an existing building, comprising:

(a) a burn chamber housing with an interior and an exterior, the housing having a burn chamber in the interior of the housing and heat radiating fins along the exterior of the housing for facilitating the heating of the air surrounding the housing, the housing defining a combustion air inlet for receiving combustion air into the burn chamber and a flue gas outlet for expelling a flue gas from the burn chamber;

(b) a first blower for creating an airflow effective to induce a first airflow between the combustion air inlet and the flue gas outlet;

(c) a burn pot mounted within the burn chamber for receiving the pelletized fuel;

(d) a window mounting apparatus for mounting the heating unit on the window, the window mounting apparatus having a substantially planar interior support portion which extends horizontally into the building when the heating unit is mounted on the window, the interior support portion effective thereon to support the housing inside the window;

a substantially planar exterior support portion which extends horizontally away from the building when the heating unit is mounted on the window; and a step portion connected between the exterior support portion and the interior support portion, the step portion extending vertically and engaging the outside of the building when the heating unit is mounted on the window, the interior support portion vertically elevated with respect to the exterior support member when the heating unit is mounted on the window;

(e) a room air passage surrounding a portion of the exterior of the housing;

(f) a second blower effective to induce a second airflow through the room air passage, the second airflow being exclusive of the first airflow, wherein air from inside the building is heated by the housing and expelled into the building;

(g) a hopper effective to store pelletized fuel, the exterior support portion effective thereon to support the hopper outside the building when the heating unit is mounted on the window;

(h) an incline plane connected to the hopper and extending inside the building when the heating unit is mounted on the window; and (i) an auger connected to the hopper and effective to deliver pelletized fuel stored in the hopper to the interior of the burn chamber.

2. The heating unit of claim 1, further comprising:

(a) a user interface device which inputs a set temperature for the housing;

(b) a controller, connected to the user interface device, for adjusting the housing to the set temperature, the controller being connected to the first blower whereby the airflow is adjusted by the controller; and (c) a temperature sensing device, connected to the controller, for measuring a current temperature on the heating unit whereby the controller adjusts the airflow such that the current temperature is substantially equal to the set temperature.

3. The heating unit of claim 1, further comprising:

(a) a user interface device which inputs a set temperature for inside the building;

(b) a controller, connected to the user interface device, for adjusting the inside of the building to the set temperature, the controller being connected to the first blower whereby the airflow is adjusted by the controller; and (c) a temperature sensing device, connected to the controller, for measuring a current temperature on inside the building whereby the controller adjusts the airflow such that the current temperature is substantially equal to the set temperature.

4. The heating unit of claim 1, further comprising a motor for driving the auger.

5. The heating unit of claim 4, further comprising:

(a) a user interface device which inputs a set temperature for the housing;

(b) a controller for adjusting the housing to the set temperature, the controller being connected to the motor whereby the controller adjusts the amount of pelletized fuel delivered by the auger; and (c) a temperature sensing device, connected to the controller, for measuring a current temperature inside the building whereby the controller adjusts the amount of pelletized fuel delivered by the auger such that the current temperature is substantially equal to the set temperature.

6. The heating unit of claim 4, further comprising:

(a) a user interface device which inputs a set temperature for the housing;

(b) a controller for adjusting the housing to the set temperature, the controller being connected to the motor whereby the controller adjusts the amount of pelletized fuel delivered by the auger and the controller being connected to the blower whereby the airflow is adjusted by the controller; and (c) a temperature sensing device, connected to the controller, for measuring a current temperature on the heating unit whereby the controller adjusts the airflow and the amount of pelletized fuel such that the current temperature is substantially equal to the set temperature.

7. The heating unit of claim 6, wherein the temperature sensing device is a thermistor.

8. The heating unit of claim 4, further comprising:

(a) a user interface device which inputs a set temperature for inside the building;

(b) a controller for adjusting the inside of the building to the set temperature, the controller being connected to the motor whereby the controller adjusts the amount of pelletized fuel delivered by the auger; and (c) a temperature sensing device, connected to the controller, for measuring a current temperature inside the building whereby the controller adjusts the amount of pelletized fuel delivered by the auger such that the current temperature is substantially equal to the set temperature.

9. The heating unit of claim 4, further comprising:

(a) a user interface device which inputs a set temperature for the inside the building;

(b) a controller for adjusting the inside the building to the set temperature, the controller being connected to the motor whereby the controller adjusts the amount of pelletized fuel delivered by the auger and the controller being connected to the first blower whereby the airflow is adjusted by the controller; and (c) a temperature sensing device, connected to the controller, for measuring a current temperature inside the building whereby the controller adjusts the airflow and the amount of pelletized fuel such that the current temperature is substantially equal to the set temperature.

10. The heating unit of claim 1, further comprising:

(a) a combustion air intake passage for delivering combustion air from outside the building to the combustion air inlet, whereby the intake passage extends outside of the building when the heating unit is mounted on the window; and (b) a flue gas passage for delivering the flue gas from the flue gas outlet to outside the building, whereby the flue gas passage extends outside of the building when the heating unit is mounted on the window.

11. The heating unit of claim 1, further comprising:

(a) a controller for adjusting the flue gas below a maximum temperature, the controller being connected to the motor whereby the controller adjusts the amount of pelletized fuel delivered by the auger and the controller being connected to the blower whereby the airflow is adjusted by the controller; and (b) a temperature sensing device, connected to the controller, for measuring a current temperature of the flue gas whereby the controller adjusts the airflow and the amount of pelletized fuel such that the current temperature is not higher than the maximum temperature.

12. A heating unit of claim 1, wherein the housing further comprises a removable door.

13. The heating unit of claim 12, wherein the removable door further comprises:

(a) the door defining an opening which provides access to the burn chamber; and (b) a cover plate being removably disposed on the opening whereby the plate is removed for ignition of the pelletized fuel.

14. The heating unit of claim 13, further comprising a guide channel which attaches around the opening, the cover plate being removably disposed over the opening by inserting the cover plate into the guide channel.

15. The heating unit of claim 1, further comprising an igniter in the interior of the burn chamber housing for igniting the pelletized fuel.

16. The heating unit of claim 15, wherein the igniter comprises a calrod.

17. The heating unit of claim 15, further comprising:

(a) a user interface device which inputs an on signal; and (b) a controller connected to the user interface device whereby the controller lights the igniter upon receiving the on signal.

18. The heating unit of claim 1, further comprising:

(a) a user interface device which inputs an air level setting; and (b) a controller connected to the user interface device and the second blower whereby the second airflow is adjusted by the controller to the air level setting.

19. The heating unit of claim 1, further comprising:

(a) a motor for driving the auger;

(b) a controller for adjusting the second airflow below a maximum temperature, the controller being connected to the motor whereby the controller adjusts the amount of pelletized fuel delivered by the auger and the controller being connected to the first blower whereby the first airflow is adjusted by the controller; and (c) a temperature sensing device, connected to the controller, for measuring a current temperature of the second airflow whereby the controller adjusts the airflow and the amount of pelletized fuel such that the current temperature is not higher than the maximum temperature.

20. The heating unit of claim 1, further comprising:

(a) a controller for monitoring the heating unit; and (b) an oxygen sensor, connected to the controller, for detecting an oxygen level within the building whereby the controller sounds an alarm when the oxygen level is not safe for humans.

21. The heating unit of claim 1, further comprising:

(a) a controller for monitoring the heating unit; and (b) a smoke detector, connected to the controller, for detecting a smoke level within the building whereby the controller sounds an alarm when the smoke detector detects unsafe fire conditions within the building.

22. The heating unit of claim 1, wherein the housing further comprises a ferrous investment casting.

23. The heating unit of claim 1, the burn pot removably mounted within the burn chamber, the burn pot further comprising a plurality of channels, the burn chamber further comprising a plurality of rails shaped to slidably receive the channels.

24. A method of heating the inside of an existing building having a window by burning a pelletized fuel, comprising:

(a) storing the pelletized fuel outside the window at a first location;

(b) transporting the pelletized fuel through the window and into a burn pot within a burn chamber housing located within the building at a second location vertically elevated with respect to the first location;

(c) drawing air from outside through the window into the housing;

(d) burning the pelletized fuel within the burnpot thereby creating a flue gas within the housing;

(e) expelling the flue gas outside the window;

(f) drawing ambient air from inside the building into an air passage surrounding the housing and heating said ambient air; and (g) expelling said heated air into the building.

25. The method of claim 24, further comprising:

mounting an interior support portion on the window so that the interior support portion extends into the building; and mounting the housing on the interior support portion.

26. The method of claim 24, wherein step (a) further comprises:

mounting an exterior support portion on the window so the exterior support portion extends outside the building; and mounting a hopper for storing the pelletized fuel on the exterior support portion.

27. The method of claim 24, further comprising:

sensing the temperature of the housing; and adjusting the amount of pelletized fuel transported into the burn pot and the air drawn from outside the window such that the temperature of the housing substantially equals a set temperature.

* * * * *